US011607594B2

(12) United States Patent
Thurber

(10) Patent No.: US 11,607,594 B2
(45) Date of Patent: Mar. 21, 2023

(54) BASEBALL HITTING TEE

(71) Applicant: John Michael Thurber, Bixby, OK (US)

(72) Inventor: John Michael Thurber, Bixby, OK (US)

( * ) Notice: Subject to any disclaimer, the term of this patent is extended or adjusted under 35 U.S.C. 154(b) by 0 days.

(21) Appl. No.: 15/441,150

(22) Filed: Feb. 23, 2017

(65) Prior Publication Data

US 2018/0036615 A1 Feb. 8, 2018

Related U.S. Application Data

(60) Provisional application No. 62/298,822, filed on Feb. 23, 2016.

(51) Int. Cl.
*A63B 69/00* (2006.01)
*A63B 21/02* (2006.01)

(52) U.S. Cl.
CPC ..... *A63B 69/0002* (2013.01); *A63B 69/0091* (2013.01); *A63B 21/025* (2013.01); *A63B 2069/0008* (2013.01); *A63B 2225/093* (2013.01)

(58) Field of Classification Search
CPC ..... A63B 2069/0008; A63B 69/0002
USPC ..... 473/436, 422, 451
See application file for complete search history.

(56) References Cited

U.S. PATENT DOCUMENTS 2,510,266 A * 6/1950 Taylor ..... A63B 69/0091 473/149
3,466,039 A * 9/1969 Golomb ..... A63B 69/0013 473/499
3,874,662 A 4/1975 Harrington
4,681,318 A 7/1987 Lay
4,830,371 A 5/1989 Lay
4,846,472 A 7/1989 Terza
4,938,478 A 7/1990 Lay
4,993,708 A 2/1991 Prosser et al.
5,035,424 A 7/1991 Liao
5,100,134 A * 3/1992 Becker ..... A63B 69/0075 473/417
5,203,558 A 4/1993 An
5,386,988 A 2/1995 Sung et al.
5,494,278 A 2/1996 Linden
5,797,810 A 8/1998 Sandoval
6,398,671 B1 6/2002 Rios
6,652,394 B1 11/2003 Tener
7,070,520 B1 7/2006 An
7,169,067 B2 1/2007 Town
(Continued)

*Primary Examiner* — Melba Bumgarner
*Assistant Examiner* — Rayshun K Peng
(74) *Attorney, Agent, or Firm* — Scott Zingerman; David Woodral; James Lea

(57) ABSTRACT

A baseball hitting/training device consisting of a hitting tee and a baseball. The ball is preferably permanently bonded/molded to a spring. In a preferred arrangement, the ball rests upon an upper tee shaft segment which acts to protect the spring. A length of the spring extends from the ball, through the upper tee shaft segment and into a middle tee shaft segment. A retainer fastens the spring to the middle tee shaft segment. The middle tee shaft segment is inserted into a lower tee shaft segment. The lower tee shaft segment is fixed to a base. When hit with a bat, the baseball remains attached to the tee by the spring and then springs back to its original upright position.

19 Claims, 5 Drawing Sheets

(56) References Cited

U.S. PATENT DOCUMENTS

| | | | | |
|---|---|---|---|---|
| 7,704,168 | B1 * | 4/2010 | Hochberg | A63B 69/0002 473/417 |
| 7,887,441 | B1 | 2/2011 | Archer | |
| 8,246,493 | B1 | 8/2012 | Ling | |
| 8,333,671 | B1 | 12/2012 | Wheelbarger et al. | |
| 8,574,101 | B2 | 11/2013 | Wheelbarger et al. | |
| 8,932,155 | B2 * | 1/2015 | Moore | A63B 63/083 473/422 |
| 9,050,516 | B2 | 6/2015 | Holland et al. | |
| 2004/0254035 | A1 | 12/2004 | Hoffman | |
| 2007/0049426 | A1 | 3/2007 | Huang | |
| 2007/0054756 | A1 * | 3/2007 | Hanson | A63B 69/0091 473/451 |
| 2011/0183781 | A1 * | 7/2011 | Chiu | A63B 69/0002 473/417 |
| 2015/0018132 | A1 * | 1/2015 | Lovelace | A63B 69/0002 473/458 |

* cited by examiner

BASEBALL HITTING TEE

CROSS REFERENCE TO RELATED APPLICATION

This application claims the benefit of U.S. Provisional Application No. 62/298,822 filed Feb. 23, 2016, herein incorporated by reference in its entirety for all purposes.

FIELD OF THE INVENTION

The present invention relates to devices for use in the game of baseball. Specifically, the device of the present disclosure relates to hitting tees for the game of baseball.

BACKGROUND OF THE INVENTION

A beginning tee ball/baseball player needs many repetitive swings of a bat to improve, become confident and develop muscle memory. The time allotted for hitting at an organized tee ball practice will be short at best. While coaches try to teach baseball fundamentals like fielding, throwing, and base running, little time is left for hitting practice. As a result, extra hitting practice at home or elsewhere is necessary. Without extra hitting practice, a tee bailer's confidence and proficiency at the plate on game-day will be diminished.

Hitting practice at home can be expensive. Costs can include a standard tee, a container of balls, a portable pop-up net, and a large area to accommodate this practice. Hitting live balls off a tee can be very time consuming. More time is spent retrieving balls and placing them on the tee than actually hitting the balls. This often results in distractions for the beginning player leading to even less time actually swinging the bat. Usually, tee practice for a child requires the involvement of an adult (or two). Bad weather and darkness often limit batting practice. Busy lifestyles often further result in little time for extra practice.

Hitting trainers presently known come in all shapes and sizes. Many are expensive, awkward contraptions with distracting appendages and cords moving in all directions. Many such known devices do not offer a realistic hitting experience. Many require a lot of space to properly operate them. Hitting machines may be prone to malfunction and damage.

A need therefore exists for a hitting tee device which provides a realistic hitting (swing) experience which can be repeated without the need to retrieve the baseball and reset it on the tee. A need also exists for a baseball hitting tee device wherein the ball may be struck and deflected and then return to the tee without human intervention. A further need exists for such a device which is durable to withstand multiple bat strikes.

SUMMARY OF THE INVENTION

The device of the present disclosure is a baseball hitting/training device consisting of a hitting tee and a baseball. The baseball may be of a lightweight foam construction. The ball is preferably permanently bonded/molded to a spring. In a preferred arrangement, the ball rests upon an upper tee shaft segment which stimulates a traditional tee ball tee. The upper tee shaft segment also acts to enclose and protect the spring. A length of the spring extends from the ball, through the upper tee shaft segment and into a middle tee shaft segment. A retainer fastens the spring to the middle tee shaft segment. The middle tee shaft segment is inserted into a lower tee shaft segment in a manner such that the middle tee shaft segment may be raised and lowered within the lower tee shaft segment. The lower tee shaft segment preferably is fixed to a base. When hit with a bat, the baseball and upper tee shaft segment deflect but remain attached to the middle tee shaft segment by the spring and then spring back into the original upright position once the bat has cleared the ball on the batter's follow through.

The present disclosure describes in a basic embodiment a baseball hitting tee including a spring having a proximal end and a distal end with a baseball affixed to the proximal end of the spring. An upper tee shaft segment having a first end and a second end is of substantially tubular geometry such that the spring extends through the upper tee shaft segment. A middle tee shaft segment includes an upper end and a lower end such that the distal end of the spring is retained by the middle tee shaft segment. The upper tee shaft segment is oriented such that the ball is positioned adjacent the first end and the second end is positioned adjacent the upper end of the middle tee shaft segment.

In an alternate embodiment, a baseball hitting tee includes a spring having a proximal end and a distal end with a baseball affixed to the proximal end of the spring. An upper tee shaft segment having a first end and a second end is of substantially tubular geometry such that the spring extends through the upper tee shaft segment. A middle tee shaft segment includes an upper end and a lower end such that the distal end of the spring is retained by the middle tee shaft segment. The upper tee shaft segment is oriented such that the ball is positioned adjacent the first end and the second end positioned adjacent the upper end of the middle tee shaft segment. A lower tee shaft segment having a top end and a bottom end such that at least a portion of the top end is tubular to receive the lower end of the middle tee shaft segment inserted into the top end of the lower tee shaft segment. The bottom end of the lower tee shaft segment is secured to a base.

The basic skill needed for hitting a baseball begins with the development of eye-hand coordination. This fundamental development is achieved by repetition—swinging a bat at a baseball over and over. The hitting tee of the present disclosure is designed to accommodate this repetition. Ideally, this repetition begins at the t-ball level of a player's skill development/age progression, however, older players also may benefit from such repetition. This is particularly true when a player is introduced to the sport at an older age.

At a typical tee ball game, one can observe that most tee ball players swing their bat tentatively and softly while trying to hit a baseball perched on top of a hitting tee. Only a small percentage of players hit the ball "in the middle" with the full power available to them with consistency. Most hitters, frequently top the ball, swing under the ball or miss the ball entirely—striking only the tee shaft. This causes the player to become timed, being most concerned about striking the ball off the tee and less concerned about striking the ball with power or precision (hitting the ball in a desired direction) An object of the present disclosure is to describe a device which allows a player to become confident in their ability to strike a ball off of a tee with power and precision.

In use, the player approaches the hitting tee of the present disclosure in the same way one would approach a standard tee. The player swings the bat at the baseball that appears to be in place on top of the tee shaft. The light-weight ball of the preferred embodiment is permanently bonded to a heavy wire extension spring. This ball and spring unit is positioned inside the upper tee shaft, attached to the tee shaft and held securely in place by a threaded screw post that runs through the tee shaft and the end loop of the spring. Upon impact by the bat, the ball and upper portion of the tee shaft bends downward. As a result, the batter/player is able to completely follow-through his or her swing, an important component of proper batting form.

Once struck an deflected downward, the light-weight ball then returns immediately to its upright position, lifted back into place by the spring's recoil. The ball is now ready to be hit again.

Benefits of the hitting tee of the present disclosure:

Through the ability to repetitively hit the ball off the tee, coupled with the prospect of more swings in a given practice period, the tee device of the present disclosure develops eye-hand coordination and "swing memory."

Since the ball does not leave the device, there is no more chasing loose balls, thus saving time and effort which can allow for more swings in a given time period.

Again because the ball does not leave the device, it can be used indoors or outdoors.

Effective, durable, long lasting training aid for players.

Since there are no balls to chase, and the ball consistently returns set upon the tee, a player can practice alone, efficiently.

Since the device of the present disclosure allows rapid swing repetition, it is excellent for teaching proper batter's stance, stride and swing.

Since the ball returns to the tee automatically, and does not need to be chased and reset, the player does not focus on mishits. A mishit resets quickly and automatically. As a result, the device trains the beginning player to hit the center of the ball.

Perfect for team practice and the "on-deck" circle.

Builds confidence for game day.

Ball height can be adjusted easily, like a traditional tee.

Since the ball can be hit and is reset automatically, practice time is much more efficient.

Since the ball does not leave the tee and become a projectile, there are no nets to assemble and no balls to chase and pick up.

Easy to carry and use anywhere. Set-up and breakdown in just seconds.

Allows for safe observation of hitter from all angles. The observer does not have to constantly watch/dodge hit (or miss-hit) balls Built to last with a steel tube construction or steel tube insert base support system.

In a preferred embodiment the tee is adjustable, preferably extending 21" to 30".

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

DETAILED DESCRIPTION OF THE PREFERRED EMBODIMENTS

Figure 2:
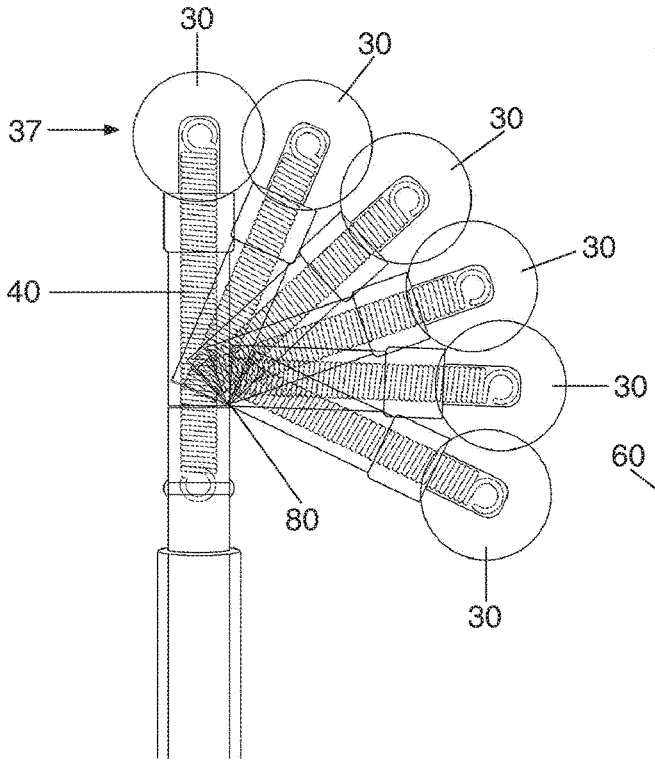
FIG. 2 is a segment defined by lines 2-2 of FIG. 1 depicting the action of the spring and ball unit such as when the ball unit is struck by a bat.

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

The tee of the present disclosure functions like a standard, stock rubber hitting tee. The intent of the design is to replicate the same look and functionality of a standard hitting tee and baseball that the player would experience on game day. With repeated use, the tee of the present disclosure will help the player develop eye-hand coordination, feel more comfortable at the plate and hit the ball more effectively. Through training on the tee of the present disclosure, a player can learn and develop the proper fundamentals of the batter's stance, the batter's stride and swing, and the batter's follow-through.

Tee ball hitting trainer tee 10 of the present disclosure includes the following in one preferred embodiment. The hitting device of the present disclosure 10 is a baseball hitting/training device generally simulating a hitting tee and a baseball. In one embodiment the hitting tee 10 is rubber and the baseball 30 is foam. In either embodiments the tee shaft could be constructed of metal such as steel.

The ball is preferably permanently bonded to a spring. White polyurethane foam ball 30 is preferably affixed to a standard extension spring 40, 1" OD/8.5" length, 0.091. A Handdrawn steel wire Jones Spring/part #145 is particularly suited for the present purpose. Spring 30 includes a proximal end 35 and a distal end 110.

This ball/spring unit 20 is preferably permanently attached to tee 10. When hit with a bat, the baseball remains attached to tee 10 and then springs back to its original upright position. The hitting tee 10 of the present disclosure is particularly suitable for tee-ball and little league players. However, a larger version of more durable construction is contemplated for use by older players such as high school players who will also benefit from repetitive swing exercises.

For the purpose of the present disclosure, the spring 40 and the ball together shall be referred to as ball unit 20. Ball unit 20 can be fixed together in any manner known in the art. However, non-limiting options include a hole 35 drilled into ball 30. Spring 40 is inserted into hole 35. Ball 30 and spring 40 are bonded together with high strength bonding adhesive. Such adhesive is commercially available from manufacturers such as 3M and others. In a second most preferred option, ball unit 20 is produced as a single part by injection molding polyurethane ball 30 around a proximal end 42 of spring 40.

The tee shaft 60 includes three sections in a most preferred arrangement. An upper tee shaft segment 95 (preferably an injection molded rubber part) is preferably of tubular geometry with open ends. Upper tee shaft segment 95 includes a first end 70 and a second end 75. Upper tee shaft segment 95 includes a first end 70 preferably integral therewith. The exterior of upper tee shaft segment 95, and particularly first end 70, may be molded so as to simulate the upper cup section of a standard tee upon which a traditional baseball would be placed. Upper tee shaft segment 95 of tee shaft 60 also serves as a protective sheath for spring 40. Upper tee shaft segment 95 is preferably tubular such that spring 40 extends through upper tee shaft segment 95. In this way, upon an errant bat swing, the bat would contact (rubber) upper tee shaft segment 95 instead of spring 40.

Tee shaft 60 includes a split at 80. This split 80 allows ball unit 20 and including upper tee shaft segment 95 to bend over upon impact by a bat. Upper tee shaft segment 95 of tee shaft 60, above the split 80, bends at split 80 with the ball unit 20 upon impact of ball 30 by a bat.

A length of distal end 110 of spring 40 extends from upper tee shaft segment 95 and into a middle tee shaft segment 90. Middle tee shaft segment 90 includes an upper end 92 and a lower end 94. Preferably middle tee shaft segment 90 is tubular, however at least a portion (upper end 92) is tubular so as to receive distal end 110 of spring 40 therein.

Figure 5:
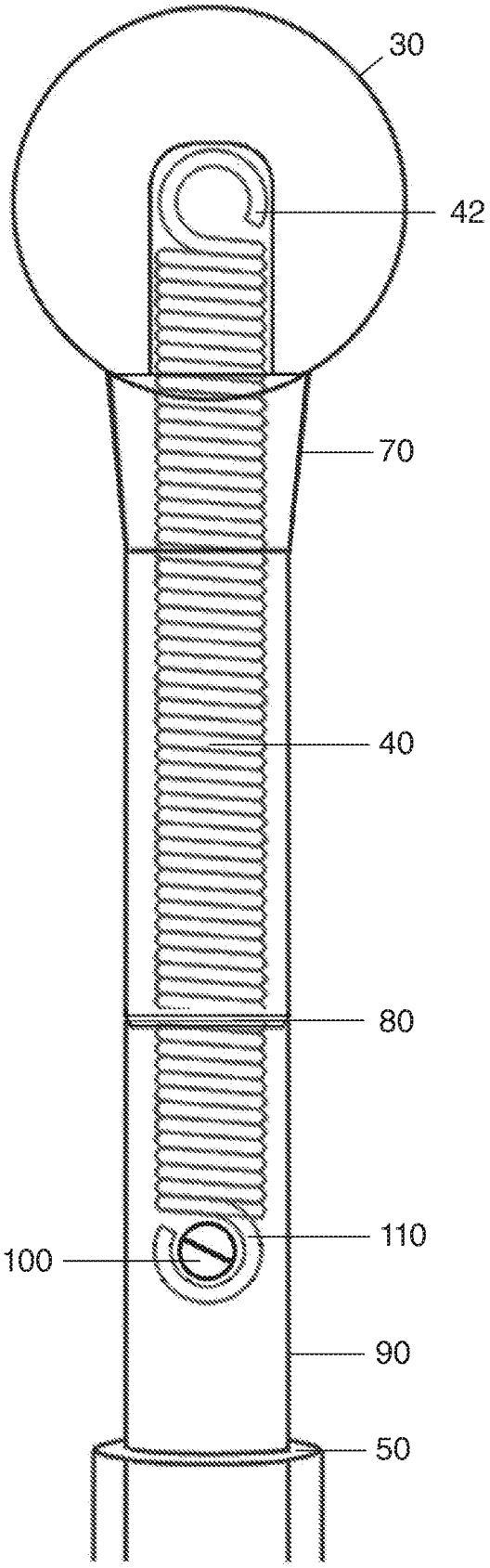
FIG. 5 is a side cut-away view depicting the manner in which the spring is retained in the middle tee shaft segment of the device of the present disclosure. The remaining pin is depicted from an end view.
Figure 6:
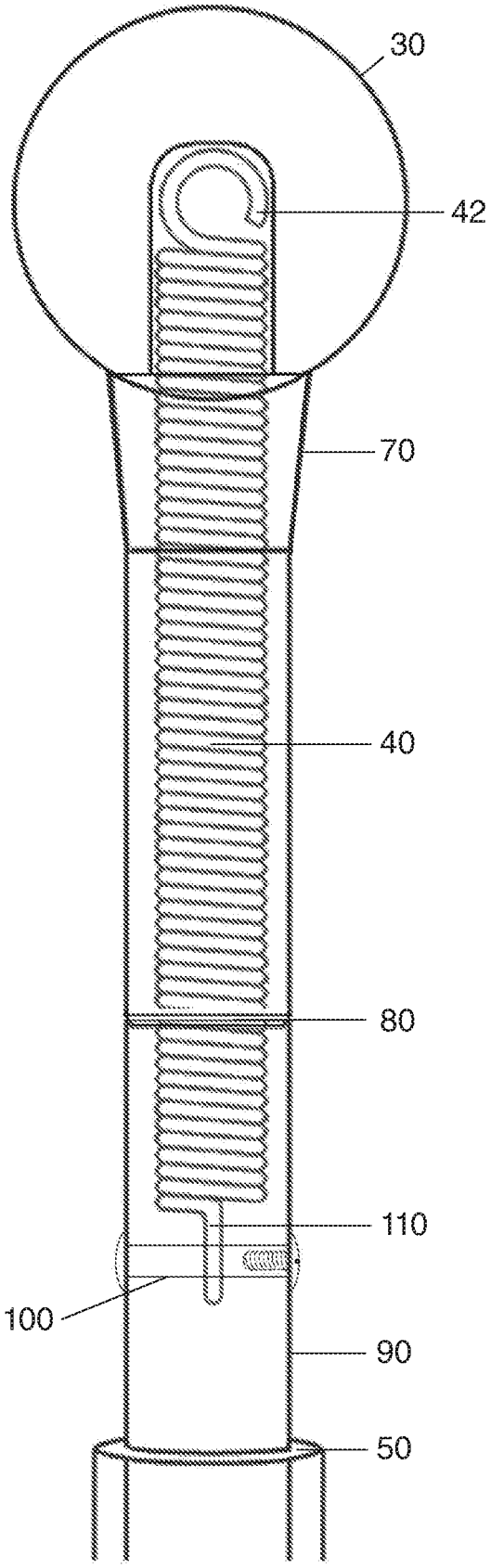
FIG. 6 is the side cut-away view of FIG. 5 rotated 90° so as to show the retaining pin from a side view.

With reference to FIGS. 5 and 6, a means for retaining distal end 110 inside middle tee shaft segment 90 shall next be described. A threaded post 100 runs through middle tee shaft segment 90 of tee shaft 60 and spring loop 112 secures the distal end 110 of spring 40 in place.

When hit with a bat as depicted in FIG. 2, ball unit 20 bends upon impact where tee shaft 60 has been split 80. Then the ball unit 20 springs back to its original upright position of FIG. 1.

Referring back to FIGS. 1-3, a lower tee shaft segment 120 includes a top end 122 and a bottom end 140. Lower tee shaft segment 120 is preferably an injection molded rubber part. Lower tee shaft segment 120 is preferably tubular but may be at least partially tubular (such as at top end 122). Top end 122 of lower tee shaft segment 120 is preferably tubular so as to receive lower end 94 of middle tee shaft segment 90. Middle tee shaft segment 90 extends into lower tee shaft segment 94 a suitable depth to retain vertical integrity of tee 10.

A means for securing lower end 94 of middle tee shaft segment 90 into the top end 122 of the lower tee shaft segment 120 may include a friction fit, bolt(s), threads, detents or any other suitable means known in the art. Means for securing the lower end 94 of the middle tee shaft segment 90 into the top end 122 of the lower tee shaft segment 120 allows middle tee shaft segment 90 to be raised and lowered (telescoped) with respect to lower tee shaft segment 120. Middle tee shaft segment 90 of tee shaft 60 can be raised and lowered within lower tee shaft segment 120 to desired height by hand. In a preferred arrangement the means includes a very tight fit which allows the middle tee shaft segment 90 to slide up and down at 50 within bottom tee shaft segment 120 but hold its position at the desired height.

Figure 1:
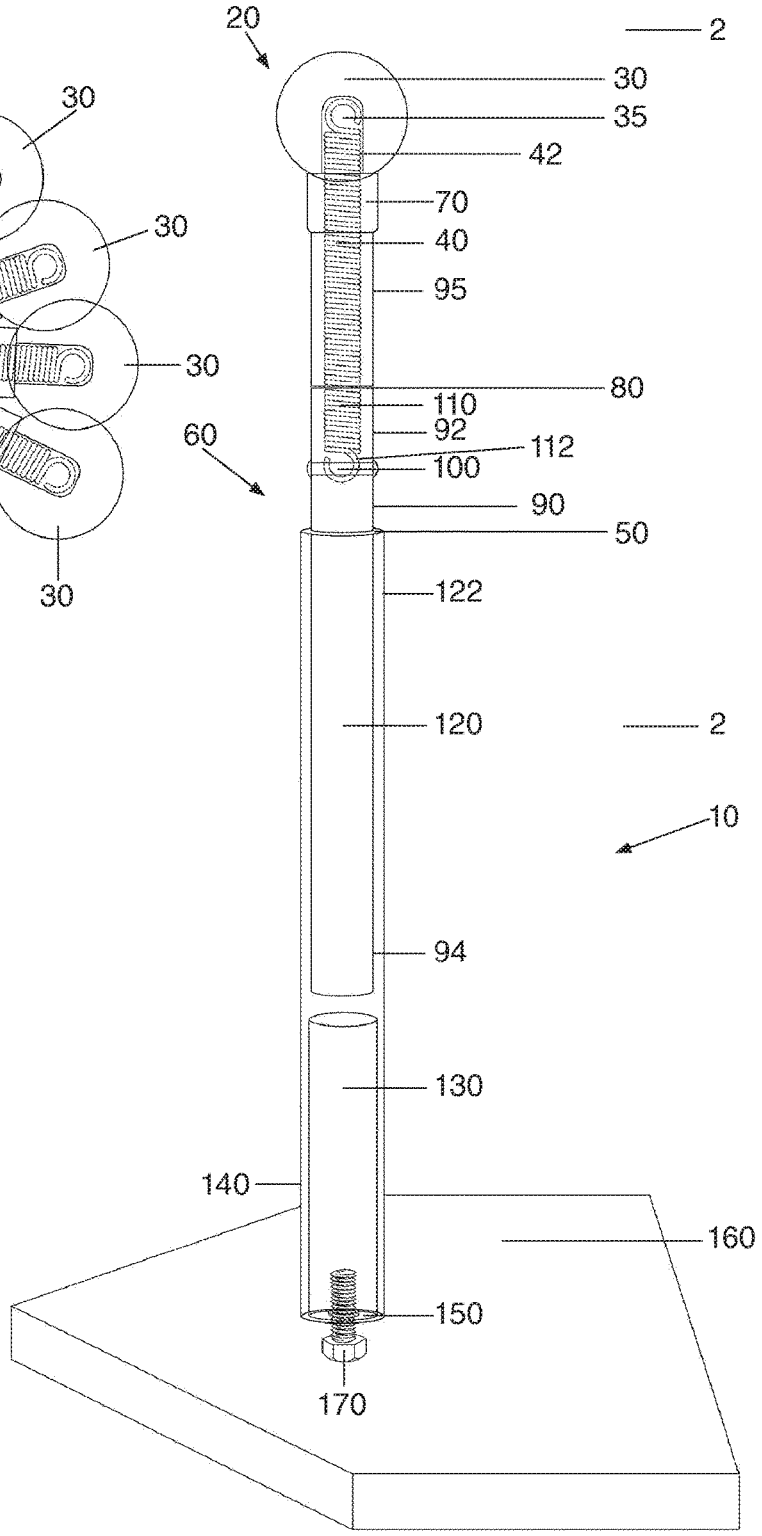
FIG. 1 is a side cut away view depicting the hitting tee of the present disclosure.

A means for supporting the lower tee shaft segment 120 in a vertical orientation (as depicted in FIG. 1) shall be next descried. This means could include a spike that is driven into the ground (see FIG. 7) or by securing lower tee shaft segment 120 directly to a base by any suitable means known in the art. In a preferred arrangement, a steel tube 130 with threaded end cap 150 inserts very snugly (friction fit) into the bottom end 140 of the bottom tee shaft segment 120.

A solid bottom base plate 160 is preferably an injection molded rubber part. Base plate 160 could be of any suitable desired shape such as pentagonal to simulate home plate. A large bolt 170 runs through the bottom of the base plate 160 and screws into the threaded end cap 150 of the steel tube insert 130 connecting rubber base plate 160 to the end 140 of bottom tee shaft 120.

The base 160 of the tee 10 is preferable fabricated of solid rubber. It provides adequate stability for the tee when the ball is hit by a child. Larger, older players who hit the ball harder may require more stability at the base of the tee to keep the tee from "rocking" or moving. The base of tee 10 of the present disclosure may optionally be constructed of a (9-lb) steel plate in the same pentagon shape as a standard "home base". This plate is positioned directly on top of the rubber base and bolted into place. In alternate embodiments, a metal plate or metal ring could be secured to or embedded within base 160 in order to reinforce base 160.

Figure 3:
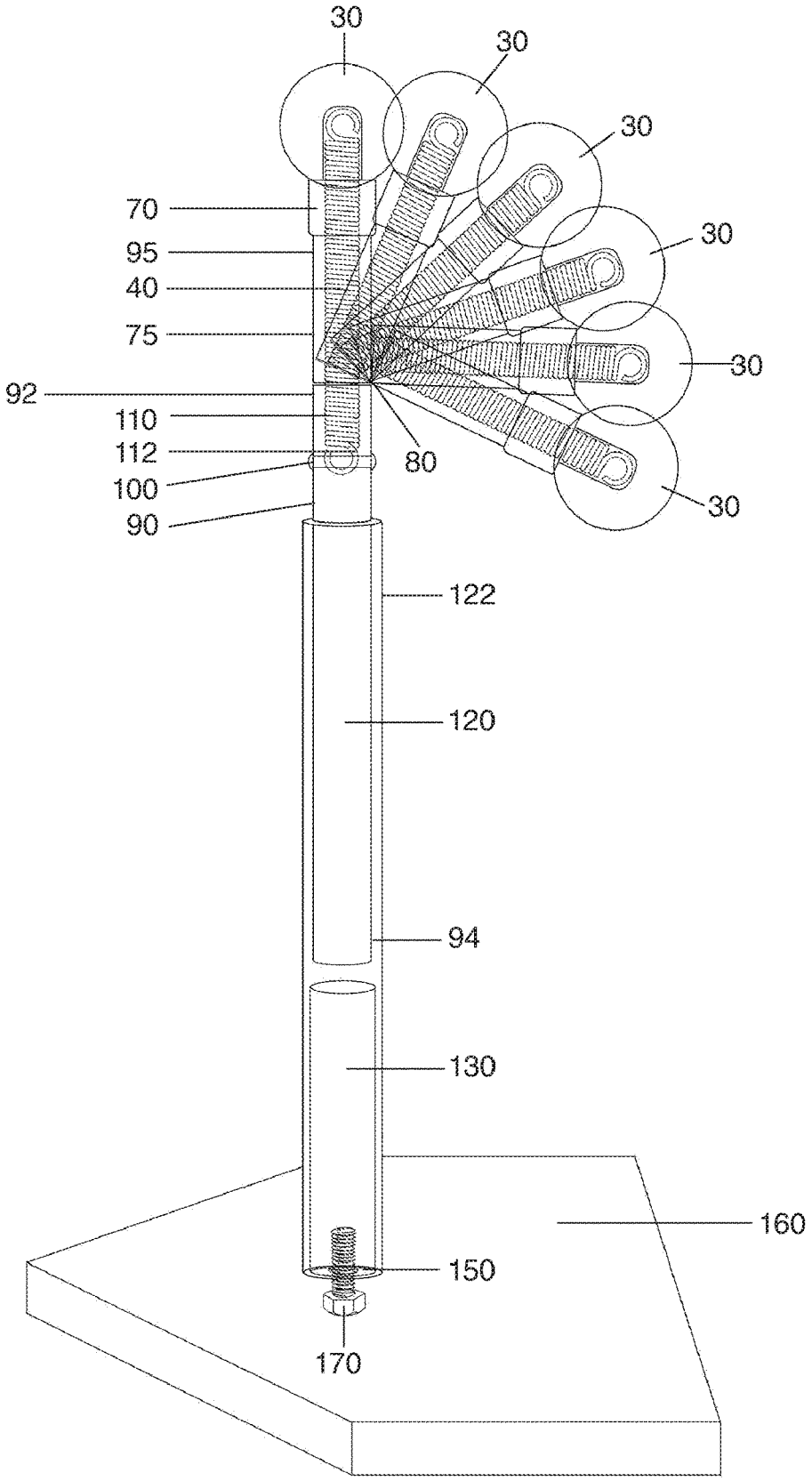
FIG. 3 is a side cut away view depicting the hitting tee of the present disclosure depicting the action of FIG. 3.

In use, with particular reference to FIGS. 1-3, the player approaches the hitting tee 10 of the present disclosure in the same way one would approach a standard tee. The player swings the bat (not shown) at baseball 30 that appears to be in place on top of the upper tee shaft segment 95. The light-weight ball 30 of the preferred embodiment is permanently bonded to a heavy wire extension spring 40. This ball 30 and spring 40 unit 20 is positioned inside the upper tee shaft segment 95, attached to the tee shaft and held securely in place by a threaded screw post 100 that runs through the tee shaft 60 and the end loop of spring 40 (FIG. 5 and FIG. 6. Upon impact by the bat, ball 30 and upper tee shaft segment 95 bends downward in the direction of the force applied by the bat striking ball 30.

Being light-weight, ball 30 then returns immediately to its upright position, lifted back into place by spring 40's recoil. The ball is now ready to be hit again.

Ball unit 20 is connected to middle tee shaft segment 90. Middle tee shaft segment 90 slides up and down within lower tee shaft segment 120 and can be adjusted by hand to the player's desired height.

Figure 4:
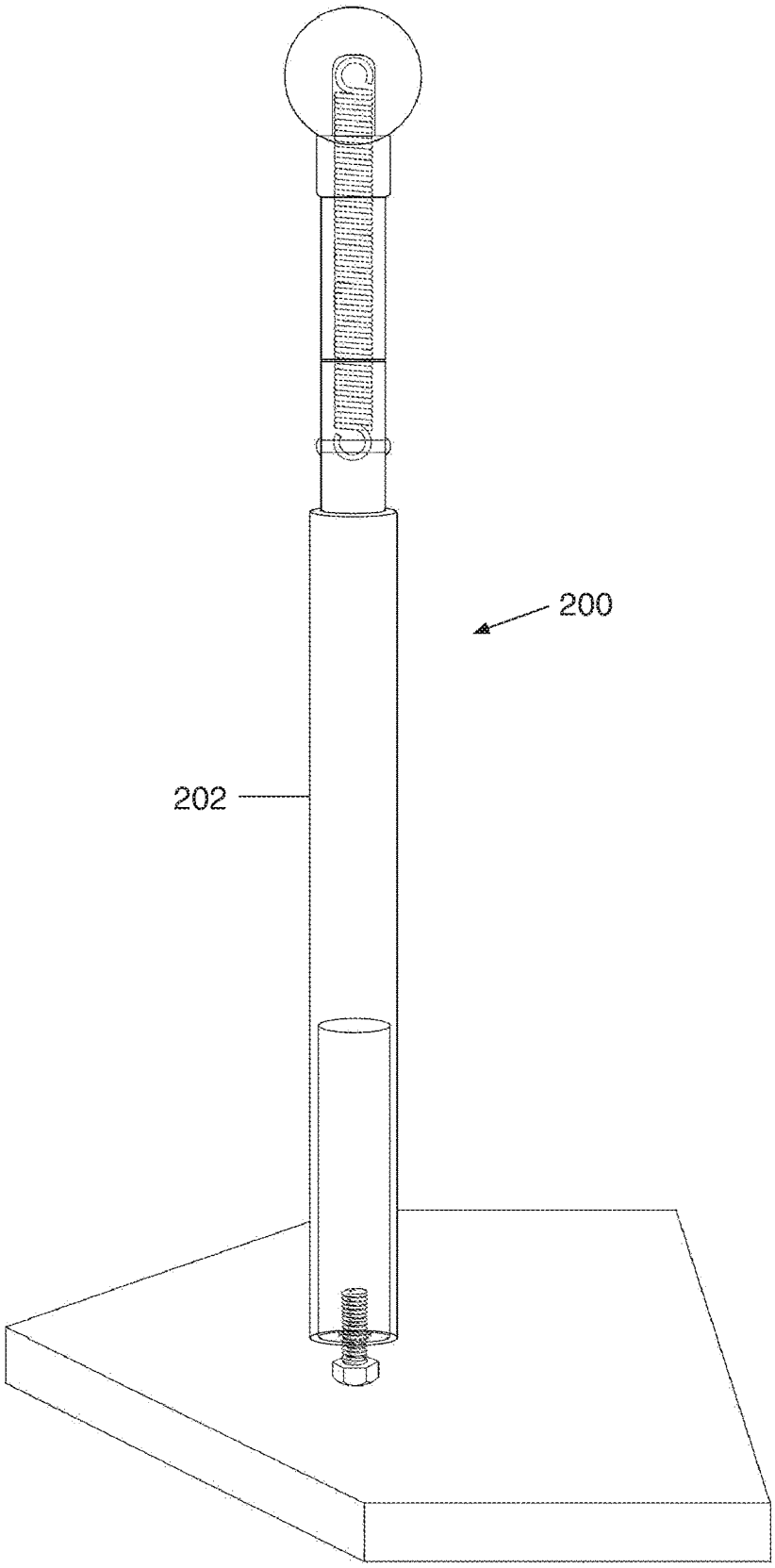
FIG. 4 is a side view of an alternate embodiment of the hitting tee of the present disclosure.

FIG. 4 is an alternate embodiment of the hitting tee of the present disclosure. FIG. 4 depicts hitting tee 200 which is substantially the same as hitting tee 10 of FIGS. 1-3 except middle tee shaft segment 90 and lower tee shaft segment 120 are a single piece 202. Single segment 202 could be made of rubber or steel for added strength.

Figure 7:
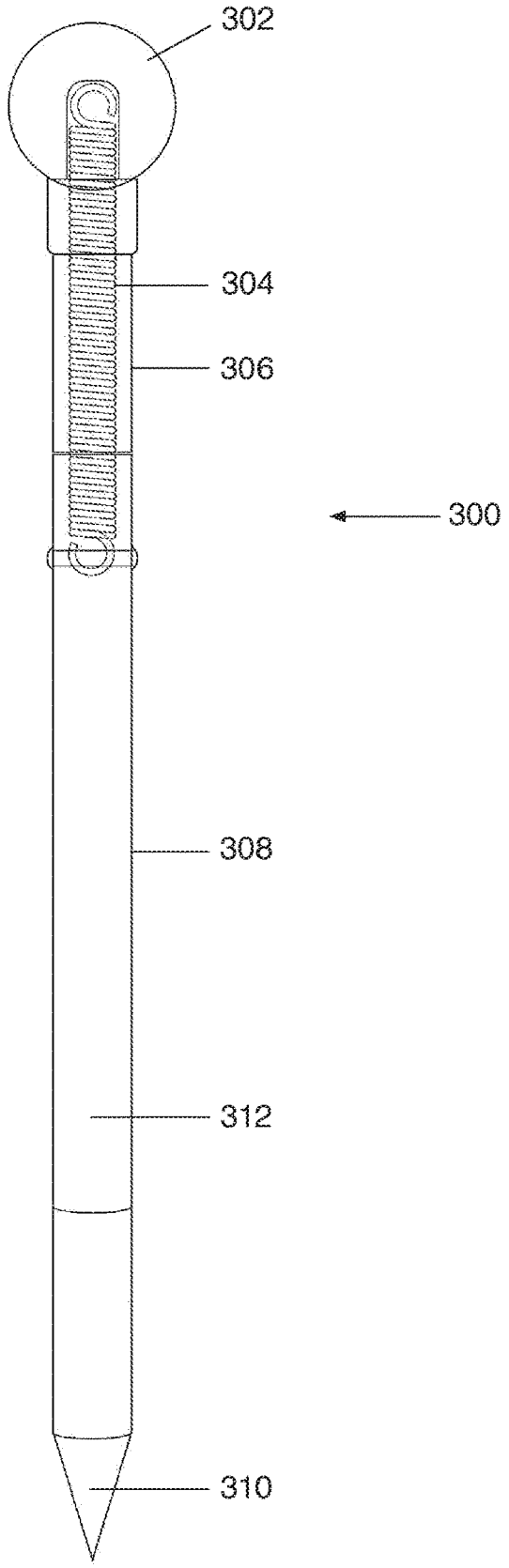
FIG. 7 is a side view of the hitting tee of the present disclosure in a basic embodiment.

With reference to FIG. 7, a basic embodiment of the baseball hitting tee of the present disclosure shall next be described. Basic embodiment 300 includes ball 302, spring 304, upper tee shaft segment 306 and middle tee shaft segment 308. Basic embodiment hitting tee 300 is constructed in substantially the same manner as hitting tee 10 described above with the exception that middle tee shaft segment 308 is not inserted into a lower tee shaft segment.

In this basic embodiment, middle tee shaft segment 308 could be secured to a means for supporting middle tee shaft segment in a vertical orientation. Means for supporting said middle tee shaft segment 308 in a vertical orientation could be substantially the same as the means for supporting the lower tee shaft segment 120 described above with regard to hitting tee 10. In FIG. 7, a spike 310 is depicted inserted into the lower end 312 of middle tee shaft segment 308 for exemplification purposes only.

In addition, and alternatively, basic embodiment 300 could be marketed and sold for insertion into a traditional batting tee base and used therewith. Alternatively, basic embodiment 300 could be marketed and sold as a replacement part for use with hitting tee 10 described above in the event that hitting tee 10 becomes worn out or damaged. Basic embodiment 300 operates in the same manner as set forth above with regard to hitting tee 10 of the preferred embodiment.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A baseball hitting tee, comprising:

a spring having a proximal end and a distal end;

a baseball affixed to said proximal end of said spring;

an upper tee shaft segment having a first end and a second end;

said upper tee shaft segment being substantially tubular such that said spring extends through said upper tee shaft segment;

a middle tee shaft segment having an upper end and a lower end;

said distal end of said spring being retained by said middle tee shaft segment;

said upper tee shaft segment being oriented such that said ball is positioned against said first end and said second end is positioned adjacent said upper end of said middle tee shaft segment such that said spring maintains said second end of said upper tee shaft segment in abutment with said upper end of said middle tee shaft segment and only said spring restricts said second end of said upper tee shaft segment from separation from said upper end of said middle tee shaft segment.

2. The baseball hitting tee of claim 1 wherein said upper end of said middle tee shaft segment being at least partially tubular for receiving said distal end of said spring.

3. The baseball hitting tee of claim 2 wherein said spring is retained in said at least partially tubular upper end of said middle tee shaft segment.

4. The baseball hitting tee of claim 3 wherein said at least partially tubular upper end of said middle tee shaft segment includes a wall of substantially circular cross section and wherein said spring is retained in said at least partially tubular upper end of said tee shaft by a pin inserted through said wall, said circular cross section, said distal end of said spring and exiting said wall.

5. The baseball hitting tee of claim 1 wherein said baseball is molded around the proximal end of said spring.

6. The baseball hitting tee of claim 1 further comprising a lower tee shaft segment having a top end and a bottom end.

7. The baseball hitting tee of claim 6 wherein said lower tee shaft segment is substantially tubular such that said lower end of said middle tee shaft segment is inserted into the top end of said lower tee ball segment.

8. The baseball hitting tee of claim 7 including means for securing said lower end of said middle tee shaft segment into the top end of said lower tee shaft segment.

9. The baseball hitting tee of claim 8 wherein said means for securing said lower end of said middle tee shaft segment into the top end of said lower tee shaft segment allows said middle tee shaft segment to be raised and lowered with respect to said lower tee shaft segment.

10. The baseball hitting tee of claim 7 further including means for supporting said lower tee shaft segment in a vertical orientation.

11. The baseball hitting tee of claim 10 wherein said means for securing said lower tee shaft segment in a vertical orientation is a base and said bottom end of said lower tee shaft segment secured to said base.

12. The baseball hitting tee of claim 10 wherein said means for securing said lower tee shaft segment in a vertical orientation comprises:

a metal sleeve inserted in said bottom end of said lower tee shaft segment;

said metal sleeve including a threaded end cap;

a base;

a bolt extending through said base and threaded into said threaded end cap.

13. The baseball hitting tee of claim 12 wherein said base is reinforced by a metal plate or metal ring within said base.

14. A baseball hitting tee, comprising:

a spring having a proximal end and a distal end;

a baseball affixed to said proximal end of said spring such that at least a portion of said proximal end of said spring extends within said baseball and said baseball is molded around said spring;

an upper tee shaft segment having a first end and a second end;

said upper tee shaft segment being substantially tubular such that said spring extends through said upper tee shaft segment;

a middle tee shaft segment having an upper end and a lower end;

said distal end of said spring being retained by said middle tee shaft segment;

said upper tee shaft segment being oriented such that said ball is positioned adjacent said first end and said second end positioned adjacent said upper end of said middle tee shaft segment;

said upper tee shaft segment being substantially rigid such that said upper tee shaft segment is adapted to articulate with respect to and at least partially separate from said middle tee shaft segment;

said upper end of said middle tee shaft segment being at least partially tubular for receiving said distal end of said spring;

a lower tee shaft segment having a top end and a bottom end such that at least a portion of said top end is tubular;

said lower end of said middle tee shaft segment being inserted into the top end of said lower tee shaft segment;

said bottom end of said lower tee shaft segment being secured to a base.

15. The baseball hitting tee of claim 14 including means for securing said lower end of said middle tee shaft segment into the top end of said lower tee shaft segment.

16. The baseball hitting tee of claim 15 wherein said means for securing said lower end of said middle tee shaft segment into the top end of said lower tee shaft segment allows said middle tee shaft segment to be raised and lowered with respect to said lower tee shaft segment.

17. The baseball hitting tee of claim 15 wherein said means for securing said lower tee shaft segment in a vertical orientation comprises:

a metal sleeve inserted in said bottom end of said lower tee shaft segment;

said metal sleeve including a threaded end cap;

a base;

a bolt extending through said base and threaded into said threaded end cap.

18. A baseball hitting tee for being struck by a baseball bat, said tee comprising:

a spring having a proximal end and a distal end;

a baseball affixed to said proximal end of said spring such that at least a portion of said proximal end of said spring extends and is secured within said baseball;

said baseball being positioned against said first end of said upper tee shaft segment;

an upper tee shaft segment having a first end and a second end;

said upper tee shaft segment being substantially tubular such that said spring extends through said upper tee shaft segment between said first end and said second end;

a middle tee shaft segment having an upper end and a lower end;

said distal end of said spring being retained by said middle tee shaft segment;

said second end of said upper tee shaft segment abutting said upper end of said middle tee shaft segment;

said spring adapted to apply a bias force to maintain said baseball positioned against said first end of said upper tee shaft segment and said second end of said upper tee shaft segment in abutment with said upper end of said middle segment;

said upper tee shaft segment adapted to at least partially separate from abutment with said middle tee shaft segment upon said baseball being struck by the bat and thereafter return to abutment by said bias force of said spring;

said upper end of said middle tee shaft segment being at least partially tubular for receiving said distal end of said spring;

a lower tee shaft segment having a top end and a bottom end;

said lower end of said middle tee shaft segment being secured to said top end of said lower tee shaft segment;

said bottom end of said lower tee shaft segment being rigidly secured to a base;

said base simulating a baseball home plate.

19. The baseball hitting tee of claim 18 wherein said middle tee shaft segment and said lower tee shaft segment are a unitary segment.

* * * * *